US007100800B2

(12) United States Patent
Yakasovic Saavedra et al.

(10) Patent No.: US 7,100,800 B2
(45) Date of Patent: Sep. 5, 2006

(54) GAS DOSING APPARATUS AND A METHOD OF DOSING PRE-SET QUANTITIES OF GAS

(75) Inventors: Tomás Ivan Yakasovic Saavedra, V Región (CL); Gonzalo Leonardo Tomasello Rayo, V Región (CL)

(73) Assignee: YT Ingenieria Ltda., Catemu (CL)

( * ) Notice: Subject to any disclaimer, the term of this patent is extended or adjusted under 35 U.S.C. 154(b) by 199 days.

(21) Appl. No.: 10/725,430

(22) Filed: Dec. 3, 2003

(65) Prior Publication Data

US 2004/0124208 A1 Jul. 1, 2004

(30) Foreign Application Priority Data

Dec. 4, 2002 (CL) ..... CL 2002-2790

(51) Int. Cl.
*B67D 5/00* (2006.01)

(52) U.S. Cl. ..... 222/3; 222/21; 222/57; 73/1.73; 128/204.25

(58) Field of Classification Search ..... 222/6, 222/55–57, 3, 21; 128/204.25; 73/1.73, 73/861

See application file for complete search history.

(56) References Cited

U.S. PATENT DOCUMENTS 4,521,139 A * 6/1985 Kretschmer et al. ..... 406/19
5,564,306 A * 10/1996 Miller ..... 73/861
5,664,563 A * 9/1997 Schroeder et al. ..... 128/204.25
6,131,572 A * 10/2000 Heinonen ..... 128/205.24

FOREIGN PATENT DOCUMENTS

CL 38271 10/1990

* cited by examiner

*Primary Examiner*—Gene Mancene
*Assistant Examiner*—Melvin Cartagena
(74) *Attorney, Agent, or Firm*—Finnegan, Henderson, Farabow, Garrett & Dunner, L.L.P.

(57) ABSTRACT

An apparatus and method of dosing pre-set quantities of gas, wherein the addition of known quantities of gas is required. The apparatus is designed to dosify gases in variable quantities, with temperature correction. The apparatus and the method is mainly applied to the gasification of containers used to transport foodstuffs, which must be kept at a controlled environment in order to better preserve them.

22 Claims, 6 Drawing Sheets

GAS DOSING APPARATUS AND A METHOD OF DOSING PRE-SET QUANTITIES OF GAS

The present invention relates to an apparatus and method of dosing pre-set quantities of gas, where the addition of known quantities of gas is required. The apparatus is designed to dosify gases in variable quantities, with temperature correction. The apparatus and the method of the present invention is mainly applied on the dosing of containers used to transport foodstuffs, which must be kept at a controlled environment in order to better preserve them.

PREVIOUS ART

A method that is known for gasifying foods, comprising a gasification chamber within which a given number of boxes may be exposed to a particular gas for a determine period of time. Once the application of gas has been completed, the chamber must be vented by releasing the gas contained in the environment, with the resulting environmental contamination, exposing, in addition, the people working close to the chambers, which may be harmful to health. This method has been strongly objected to in Good Agricultural Practices (GAP), reason by which its use has been opposed to and questioned, and such other methods as box-to-box gasification, have been preferred.

A box to box gasification unit is disclosed in Patent CL 38271. This gasification equipment uses indirect metering of the quantity of gas that is to be injected, the equipment, specifically, uses a graded Vaseline column to measure the quantity of gas that is to be injected through the displacement of the Vaseline on the column. The gas fills a compartment that forces the Vaseline stored therein to rise through a vertical transparent tube allowing to determine the quantity to be injected. An inconvenience of the equipment disclosed in Patent CL 38271 is that said equipment does not consider the temperature factor in the metering of gas expansion displaced by the Vaseline column. In fact, on a regular work day, working temperature may vary up to 20° C., implying that an error of some 3% or more in the quantity of the gas that is metered on the graded Vaseline column. In addition, special care must be taken in keeping in a vertical position the equipment disclosed in said patent, since any inclination or overturning may cause the emptying of the Vaseline chamber and equipment's failure to operate until the tanks is refilled with the regular amount of Vaseline. In other words, the equipment cannot be operated.

The purpose of the apparatus of the present invention is to provide a simple apparatus able to deliver known quantities and to dosify exact quantities of gas. The box to box application requires the addition of known quantities of gas, since quantities smaller than those recommended might not have the desired effect, and greater quantities may damage the product and cause a gas loss, resulting in extra costs. In addition, the apparatus in the present invention is easy to operate and may be handled without having to keep it in a vertical position. On the other hand, the apparatus in the present invention is small, thus making it possible to use it as a portable unit.

The present invention allows gas dosing for industrial applications that require the addition of known quantities of gas. The apparatus of the present invention may be used in the gasification of containers with grapes for export, where the requirements to add SO2 as a fungistatic is well known.

The gas dosing apparatus allows to dosify from small dosages, fractions of cubic centimeters, to liters, by using the same technology. It must be noted that, in practice, the equipment does not have any moving parts, save for the inlet valve and the outlet valve, which reduces the risk of failure. The mentioned inlet and outlet valves are instruments of industrial use, designed for extensive operation. All of the electronic circuits use, mainly, digital technology, which makes the gas dosing apparatus of the present invention be small and easy to handle. In addition, it allows to reduce failures of the apparatus to a minimum and simplify the equipment's maintenance requirements. All this resulting in low operational costs.

The nature of the present invention will be more easily understood through the description of the figures contained herein and from the description of an embodiment of the present invention.

DESCRIPTION OF THE DRAWINGS

FIG. 1 illustrates a schematic diagram of the apparatus of the present invention, wherein the full line represents the gas circuit, the dotted line represents the control circuit and the broken line represents the equipment directly involved in the dosing.

Figure 1:
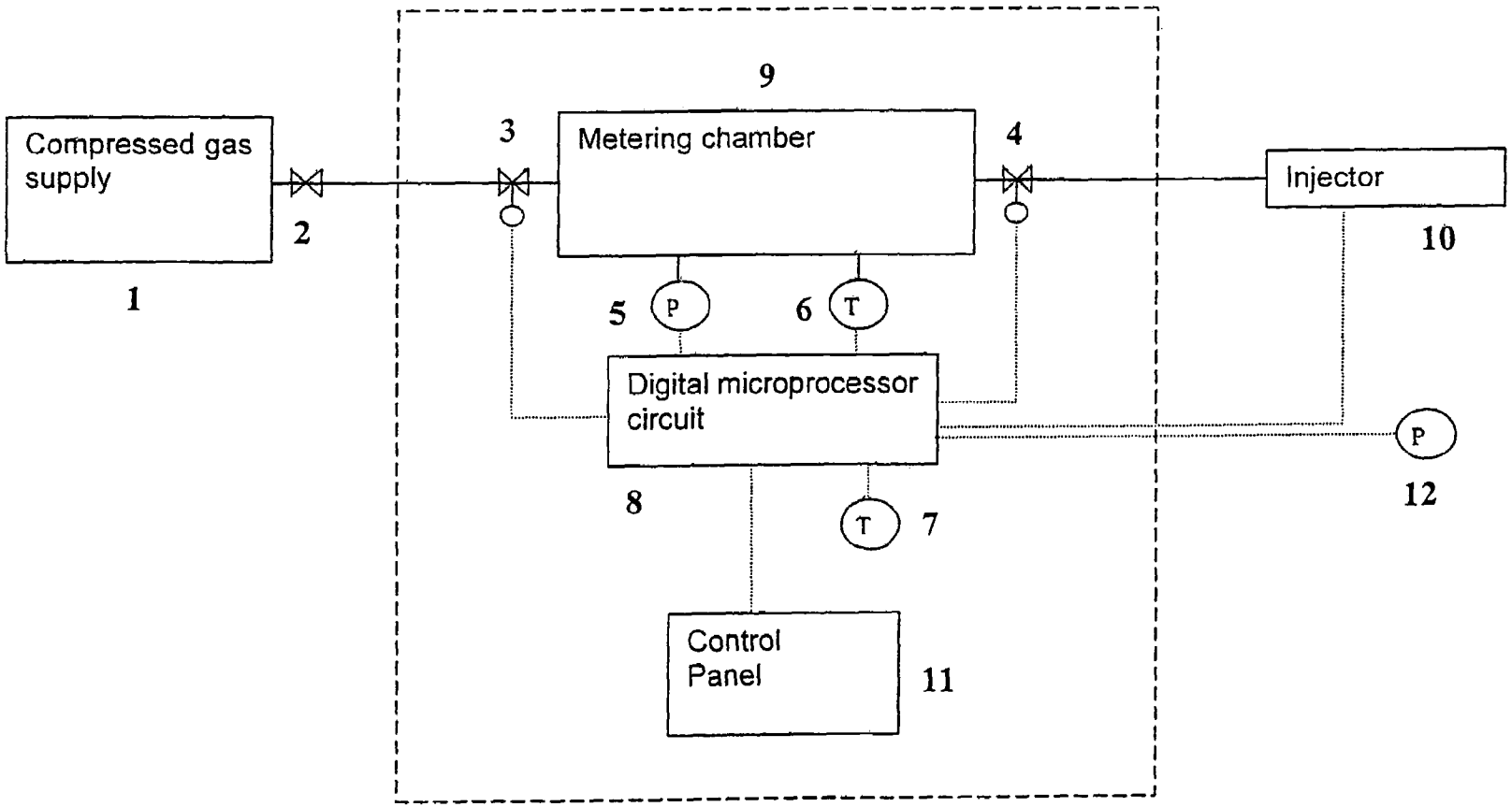
FIG. 1 shows a schematic diagram of the apparatus of the present invention.

In the apparatus of the present invention, comprising a known volume container or metering chamber (9) destined to contain the gas to be injected, this metering chamber (9) is connected through an inlet duct to a compressed gas supply (1) that may contain any gas (whether or not liquefied) that is wished to be dosified.

Between the compressed gas supply (1) and the metering chamber (9) is a shut-off valve 2 and an intake valve (3). The intake valve (3) is an electrovalve through which the flow of gas from the compressed gas supply (1) to the metering chamber (9) may be regulated.

The metering chamber (9) is connected, through an outlet duct, to a final dosing system or injector (10). Between the metering chamber (9) and the final dosing system (10) is outlet valve (4). The outlet valve (4) is an electrovalve by which the flow of gas from the metering chamber (9) to the final dosing system or injector (10) can be regulated.

In the metering chamber (9) are two sensors used to measure the pressure and temperature inside the metering chamber. The pressure sensor (5) makes it possible to permanently measure pressure inside the metering chamber. The temperature sensor (6) makes it possible to continuously measure gas temperature inside the metering chamber (9), at regular intervals or each time a temperature record is required.

In addition, on the external side of the gas dosing apparatus and exposed to the environment is a temperature sensor (7) which allows to measure room temperature permanently, at regular intervals or each time a temperature record is required. The external temperature sensor (7) must be placed at the location where final dosing takes place. Additionally, on the external side of the gas dosing apparatus there may be an external pressure sensor (12). The external pressure sensor is optional, being able to be a single one or an arrangement of sensors. This external pressure sensor may not be present, and a pressure sensor (5) located inside the metering chamber (9) may be alternatively used to measure external pressure, keeping open the oulet valve (4) and allowing internal pressure equal the external pressure.

Both the external and the internal sensors must be placed where dosing takes place, since it is the conditions of that environment which must be measured . They may alternatively placed in areas where the conditions do not differ substantially therefrom.

The temperature and pressure sensors are connected to an electronic control system comprising a digital microprocessor circuit (8) and a control panel (11). The microprocessor allows to process the data provided by the temperature and pressure sensors, and makes the necessary calculations from the data entered the control panel (11) to determine the correct gas amount to be applied.

Figure 2:
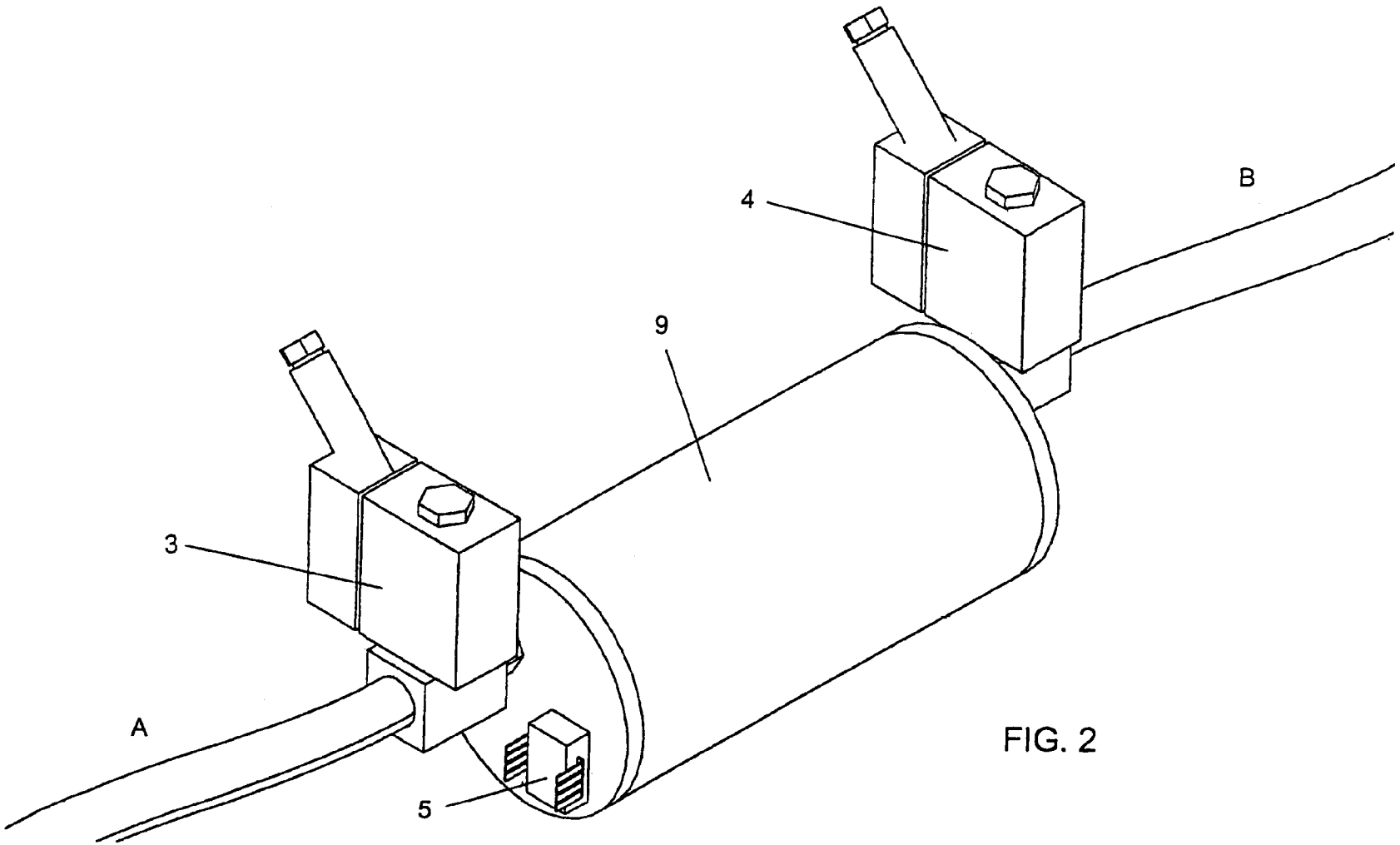
FIG. 2 shows a top view of a preferred embodiment of the dosing apparatus of the present invention.

FIG. 2 shows a top view of a preferred embodiment of the gas dosing apparatus of the invention comprising a known volume container or metering chamber (9) that is connected through an inlet duct (A) to a gas source. The metering chamber (9) is connected through an outlet duct (B) to a final dosing system (not shown).

In FIG. 2, the metering chamber (9) has been schematized with a cylindrical shape; however, said chamber may have any shape, provided it holds a known and constant volume with which the equipment is calibrated. In addition, the size of the chamber is determined by the amount of volume to be dosified and the material must resist the gas pressure that must contain between each application.

Figure 3:
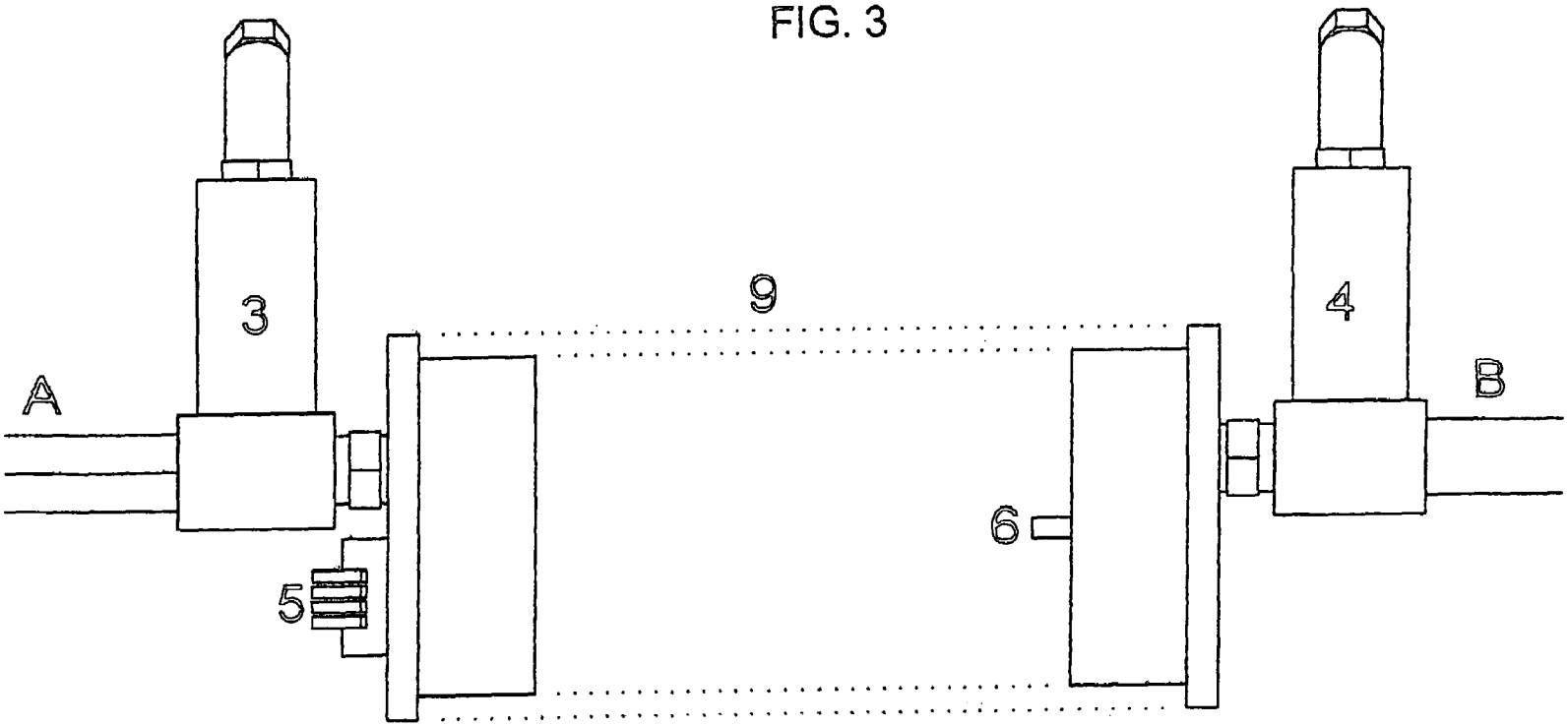
FIG. 3 shows a cross section of a preferred embodiment of the apparatus of the present invention.

FIG. 3 shows a cross section of the preferred embodiment of the apparatus shown in FIG. 2. The known volume container or metering chamber (9) has been drawn with a dotted line as a way of showing that the shape of the chamber is not crucial in the gas dosing apparatus of the present invention. FIG. 2 also shown the temperature sensor (6) inside the metering chamber (9).

Figure 4:
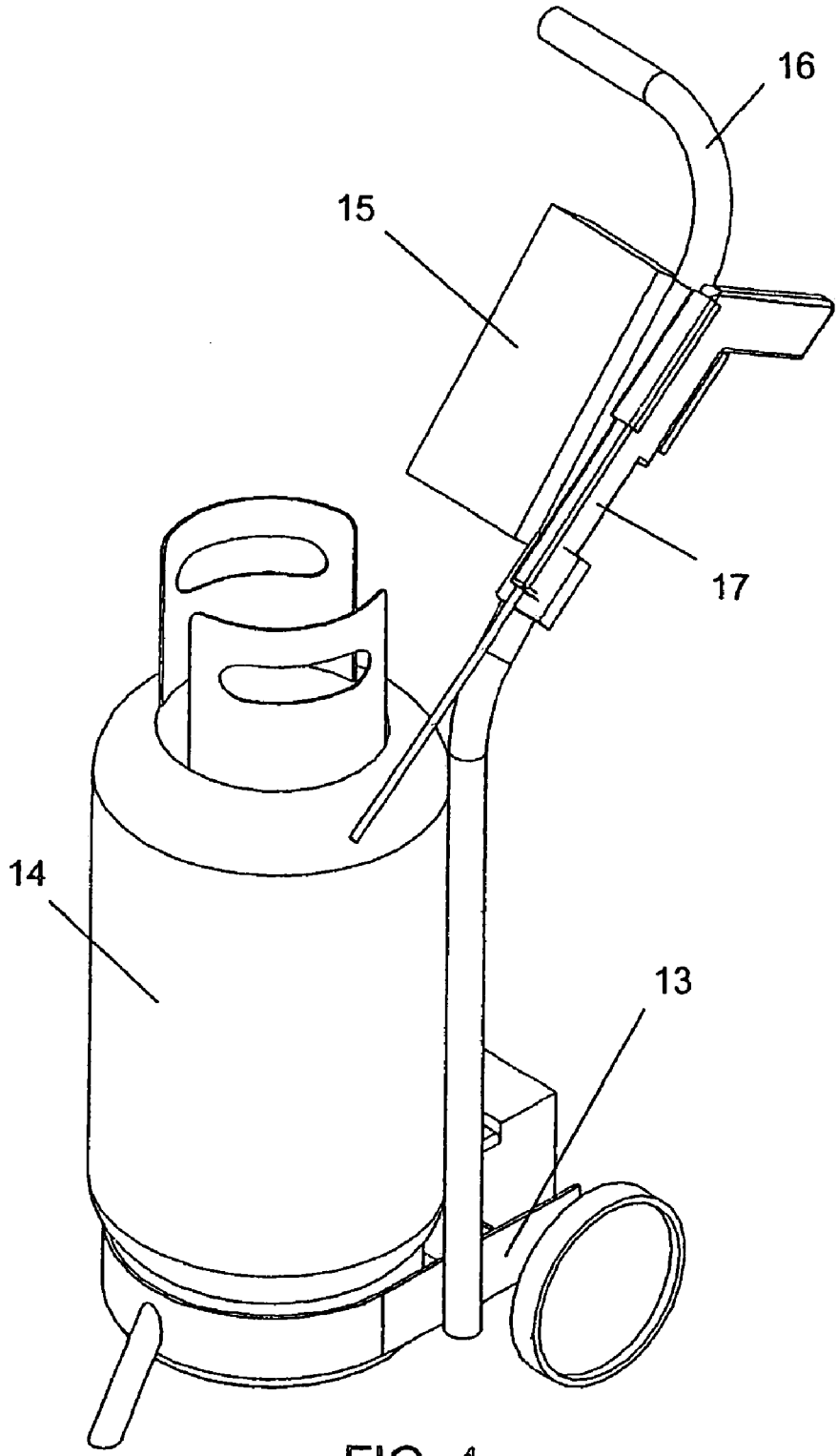
FIG. 4 shows a preferred embodiment of the apparatus of the present invention.

FIG. 4 represents one of the preferred embodiments of the dosing apparatus of the present invention that is related to a car) (3) thereby a compressed or liquefied gas container (14) may be transported, from which the gas dosing apparatus is fed with gas. This car must allow the assembly of the batteries, or it may be used directly connected to the regular power supply or to other source of power. The car is designed to allow a faster access to the work place, considering that the mobility of the car will be a medium requirement. Generally, the pressures in the metering chamber are slightly higher than the discharge pressures, which ensures an optimum use of the gas accumulated in the container. It may be observed in FIG. 4 that the dosing apparatus of the present invention is in the box (15) attached to the car fastening handle (16), into which an injection system (17) has been incorporated.

It must be noted that FIG. 4 is only a representation of an embodiment of the present invention and is intended to show the size of the gas dosing apparatus and, by no means it intends to limit the present invention.

Figure 5:
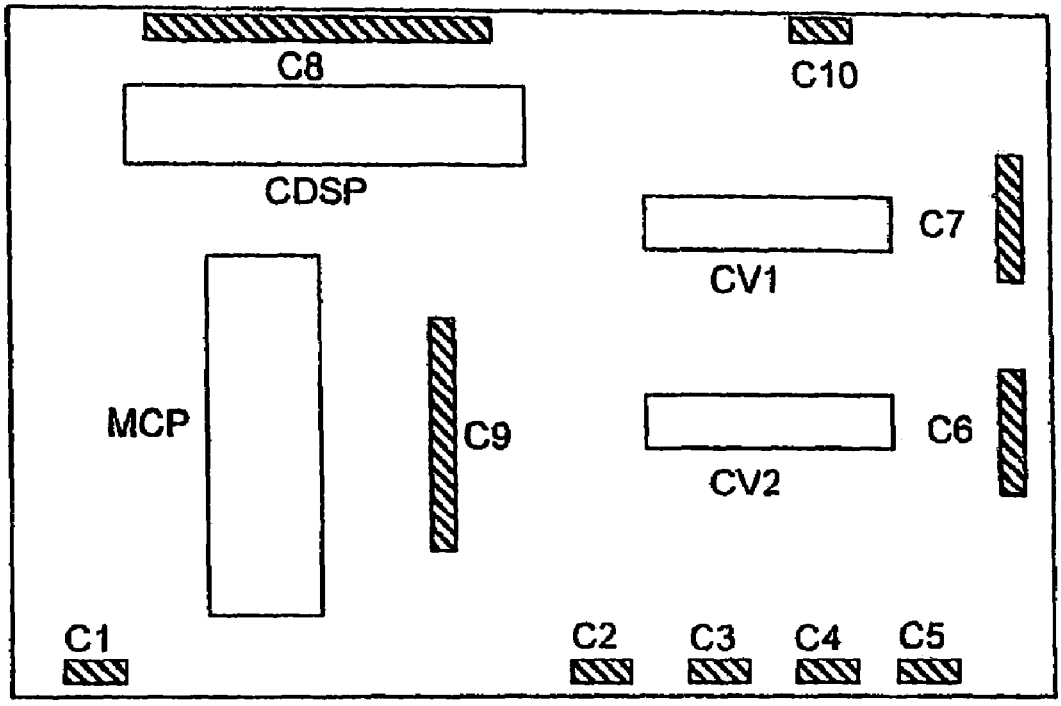
FIG. 5 shows the main components of the electronic circuit.

FIG. 5 is a diagram of the main components of the electronic circuit, wherein the microprocessor (MCP), the monitor or display controller (CDSP), the valve controllers (VC) and connectors (c) are represented.

Specifically, FIG. 5 shows the following components:

CV1: controller of the intake valve to the metering chamber;

CV2: controller of the outlet valve from the metering chamber;

C1: power supply connector;

C2: internal temperature sensor connector (inside metering chamber);

C3: external temperature sensor (injection environment);

C4: internal pressure sensor connector (inside metering chamber)

C5: external pressure sensor connector (environment), for the embodiment of the dosing apparatus that contemplates the use of an external pressure sensor;

C6: connector to the outlet valve of the metering chamber;

C7: connector to the intake valve to metering chamber;

C8: connector to display;

C9: connector to control panel (all of the components, except for display);

C10: connector to injection system.

Figure 6:
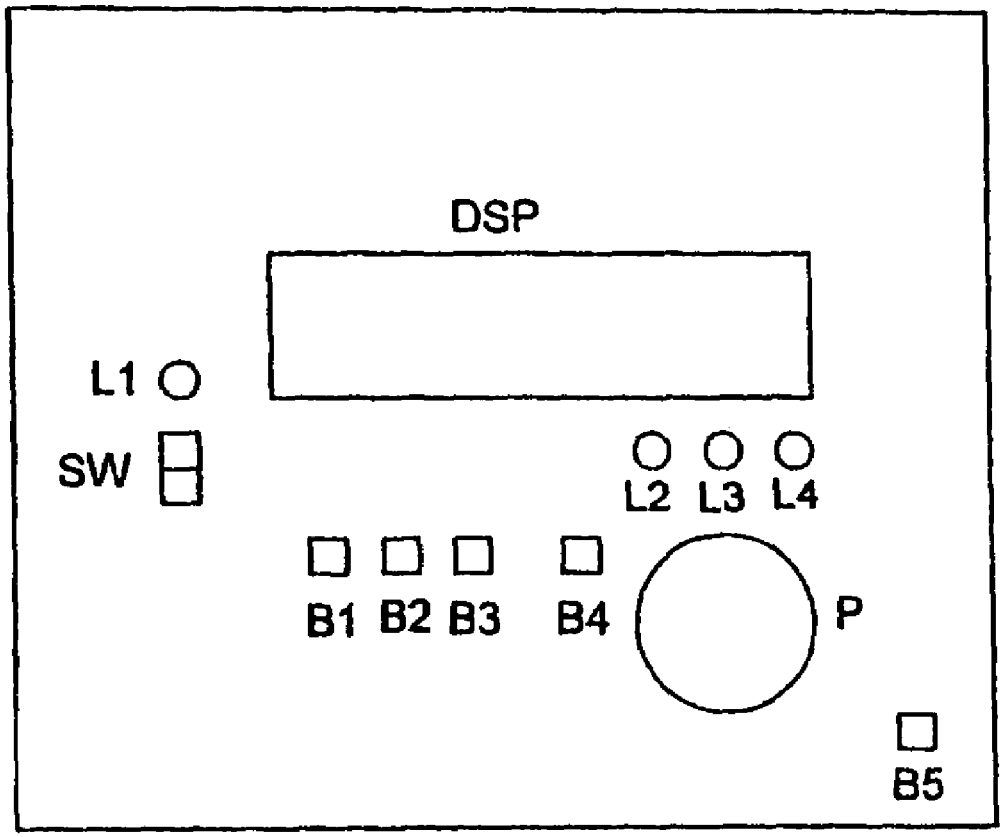
FIG. 6 shows an example of the front of the control panel.

Shown in FIG. 6 is an example of the front side of the control panel, with L representing a led and the buttons represented by B, with SW being the equipment's start pushbutton, DSP being the monitor or display, and the regulation dial being represented by P, wherein P is the dial to set up the mass or volume dosing parameters. The adjusted value is shown in the display.

FIG. 6 specifically illustrates the following components:

L1: start led;

L2: injection mode led (normal operation);

L3: parameter input mode led (volume or mass) of injection (configuration);

L4: external pressure set up mode led (model with only 1 pressure sensor).

B1: pushbutton to enter volume injection configuration mode;

B2: pushbutton to enter mass injection configuration mode;

B3: pushbutton to enter external pressure setup mode;

B4: Accept pushbutton to accept input parameters.

B5: Totalizer pushbutton, displays all of the injections executed by the equipment; being this latter value used to determine the periodical maintenance of the gas dosing apparatus.

DETAILED DESCRIPTION OF THE INVENTION

The present invention refers to an apparatus to dosify known quantities of gas where the addition of exact amounts of gas is required.

The gas dosing apparatus is mainly comprised of:

i) A primary gas circuit that starts with the supply container or compressed gas supply (1), which may be any compressed gas (liquefied or otherwise) or a pressurized line from which the gas to be dosified may be obtained. At the exit of the gas supply is a gas shut-off valve (2). The gas from the gas supply (1) is transferred through an inlet duct or a high pressure hose (A) to the entrance of the metering chamber where there is an intake electrovalve (3) that regulates the flow of gas into the metering chamber (9). depending on the storage gas pressure in the supply system or supply of compressed gas, and at the dosing pressure, at the exit of the supply system, in addition to a shut-off valve (2), a pressure regulating valve may be required.

ii) Metering chamber: immediately after the intake valve (3) is a metering chamber (9) with known and constant volume, where are two sensors, a pressure sensor (5) allowing to measure the pressure inside the chamber continuously or each time a pressure record is required, and a temperature sensor (6) allowing to measure the temperature inside the metering chamber continuously, at regular intervals or each time a temperature record is required. The chamber ends up with an outlet electrovalve (4) that allows to discharge the quantity.

iii) A secondary gas circuit that starts with the outlet valve (4) allowing the flow of gas that is conducted through a high pressure hose or outlet duct (B) to the final dosing point. The outlet duct may end up in a final dosing system (10) made up of an injector that facilitates the dosing of gas inside the container and it may even allow the injection of gas within a bag or any other kind of container.

iv) An electronic control system. This system is the equipment's operating system and is mainly comprised of: a state-of-the-art microprocessor (8) and a control panel (11). At the end of the dosing, the outlet valve (4) is switched by the microprocessor (8) upon receiving a signal produced by the final dosing system or ejector (10), according to the data delivered and measured, starting a new charging cycle of the metering chamber (9).

The microprocessor (8) has in its memory a program that allows to correctly interpret the data in order to execute the necessary actions for the dosing. The memory of this microprocessor (8) contains a program that allows to correctly interpret the date in order to be able to execute the necessary actions for dosing. This microprocessor receives data input by the user from the control panel (11). With this data, a state-of-the-art microprocessor calculates the correct amount to apply, which is determined by decreasing the pressure inside the metering chamber during the discharge.

The control panel (11) is made up of a system having a display, pushbuttons and knobs to turn the equipment on and off, allowing to visualize and set the desire amount of gas, check internal records and general information. At the control panel is specified the amount of gas that is to be dosified in units of volume or mass. With the data of amount of volume or mass of gas to be dosified, in conjunction with the information received through the pressure sensors (5) and (12) and from the temperature sensors (6) and (7) of the apparatus, the electronic control system is able to calculate the parameters required to dosify the exact amounts of gas.

Detailed Description of the Components

Intake Valve (3)

The intake valve (3) or intake electrovalve allows to count the flow of gas from the gas supply (1) to the metering chamber (9). This intake electrovalve must be suitable to the operating conditions, that is, for intake pressure versus pressure in the metering chamber. The size of the valve must be suitable to achieve the amount within reasonable times.

Outlet Valve (4)

The outlet valve or outlet electrovalve (4) allows to cut the flow of gas from the metering chamber through the outlet duct to the dosing system or injector (10). This outlet electrovalve must be suitable to operating conditions, that is, for the pressure inside the metering chamber versus the pressure of the gas discharge. The size of the valve must be suitable to achieve the amount within reasonable times.

The material of the electrovalve must be adequate to be used with the gas or mixture of gases to be dosified; the materials of the body and he parts in contact with the gas must be inert to the action of the gas. The materials used for the construction of this type of valve may be chosen from among iron, stainless steel, bronze, other metallic alloys, plastic polymers, etc., which are adequate for different kinds of gases or mixtures thereof.

Metering Chamber (9)

The metering chamber (9) must comply with the basic condition of having constant and known volume, since with this volume value the equipment is calibrated. The material of the metering chamber must be suitable for use with gas or mixture of gases to be dosified. The metering chamber may have any shape, provided that allows to insure the constant and known volume condition. The preferred shapes of metering chambers are those having rather flat or rounded surfaces, preferably with convex or concave walls and with ellipsoidal or cylindrical chambers being the preferred ones for their better mechanical performances against internal gas pressures. The size of the metering chamber may vary from a few cubic centimeters to various liters or cubic meters. The volume of the chamber is determined by the range of volume to be dosified, inlet pressure and discharge pressure, which is determined upon the construction of the gas dosing apparatus.

Pressure Sensor (5) of the Metering Chamber

The pressure sensor (5) of the metering chamber may have analog or digital outputs, and must be mounted within the chamber or externally connected thereto, so that it may determine the internal pressure. The response time will depend in the type of final application, being preferred those with fast response to obtain greater accuracy. The size of the pressure sensor must be suitable to the size of the metering chamber. The material of the pressure sensor must be inert to the gas o mixture of gases to be dosified.

Temperature Sensor (6) of the Metering Chamber

The temperature sensor (6) of the metering chamber may have analog or digital outputs, and must be mounted within the chamber or externally connected to the metering chamber, so that it may determine, at all times, the temperature of the gas or mixture of gases inside the chamber. The response time will depend in the type of final application, being preferred those with fast response to obtain greater accuracy. The size of this sensor must be suitable to the size of the chamber. The material of the sensor must be inert to the gas o mixture of gases to be dosified. As for large to very large chambers, there may exist more than one temperature sensor in order to measure in different zones and obtain a more representative measurement of the temperature inside the metering chamber.

External Pressure Sensor (12)

The external pressure sensor (12) may have analog or digital outputs, and must be located or may be located in the dosing's discharge environment, so that it may determine the target pressure. The pressure sensor's response time will depend on the final application, being preferred those of fast response to have greater accuracy. The material of the sensor must be inert to the gas or mixture of gases to be dosified and to the dosing environment.

Alternatively, in order to measure pressure at final dosing environment the same pressure sensor (5) of the metering chamber maybe used. To measure the pressure in the dosing environment with the pressure sensor (5), the outlet valve (4) must be opened while the end of the injection system is inside the injection environment and a suitable period of time must elapse in order for the pressure inside the injection environment to equalize the pressure in the discharge environment of the dosing.

External Temperature Sensor (7)

The external temperature sensor (7) may have analog or digital outputs, and must be located or may be located in the discharge environment of the dosing, so that it may determine the target temperature of the gas. This sensor's response time will depend on the final application, being preferred those of fast response to have greater accuracy. The size of this sensor must be adequate to the chamber. The material of the sensor must be inert to the gas or mixture of gases to be dosified and to the dosing environment.

Alternatively, the internal temperature sensor of the metering chamber may be used to measure the external temperature. To do so, a special procedure must be followed by opening the outlet valve (4) while the end of the injection system is inserted into the injection environment and temperatures are allowed to equalize within the metering chamber and the injection environment. Although this option is possible, not always is to advisable due to the long periods to time that are required for the stabilization of the internal and external temperatures, which does not allow a continuos control of the temperature.

Control Panel (11)

The control panel (11) allows to enter dosing parameters, such as the volume to discharge conditions or the mass of gas that is to be injected or dosified. If the mass parameter is to be used to specify the amount of gas to be dosified, the molecular weight of the gas or mixture to be dosified must be first specified in the equipment. The previous specification of the molecular weight of the gas may be done by a setup on the printed plate or on the panel through selectors (jumpers, switch), through the control panel (using the keyboard, dial or other mechanism provided to said effect), set in the microprocessor or through a data channel (serial, radio frequency, or any other alternative way of data transmission), depending on the configuration of the equipment. The amounts to be dosified may be entered by using a dial, a pushbutton selector or the like, or through a keyboard. A preferred option to enter the quantities to be dosified is by way of a dial with display of the value on the monitor or display in the control panel. To do so, a parameter input mode must be selected on the panel control and then the dosing method (volume or mass) must be selected.

The control panel also allows to visualize the number of injections carried out, the absolute totalized ones (from the equipment's commissioning) as well as partial ones as defined by the user, for a "taken to zero" option is provided. This latter option allows to control the dosing made within a period of time. The totalized value allows to control the use of the equipment and to schedule maintenance operations. In addition, the indicators on the control panel allow to verify whether the system is receiving electric power and whether the chamber is loaded for a new dosage. The indicators on the control panel also allow to verify whether the pressure has reached the required value inside the chamber or otherwise. If the pressure does not reach the value required, the intake line would have a pressure failure.

Digital Microprocessor Circuit (8)

The digital microprocessor circuit (8) allows to execute the dosing's logic and is based on a state-of-the-art microprocessor, which makes it possible to substantially reduce the size as compared to older (analog) technologies. The microprocessor may be regarded as the equipment's operating system, since it makes the necessary calculations to carry out the dosing, such as measurements and their interpretation. Basically, the system executes the following logics and sequences, although not necessarily in this order and being not the only functions it executes. The process is described in the microprocessor through a program especially written thereto.

Description of the Method of Dosing

The general concept of the dosing apparatus of the present invention comprises the steps of measuring an exact quantity of gas by the use of a metering chamber for a known and constant volume by increasing the pressure inside the metering chamber, with the appropriate corrections when knowing the pressure and temperature of the gas and the external pressure and temperature. The equation relating the volume, pressure and temperature variables is well known, it is the ideal gas law:

$$P \cdot V = n \cdot R \cdot T$$

where P is the pressure inside the metering chamber, V is the volume of the metering chamber, n is the number of moles of the gas, R is the gas constant and T is the absolute temperature. The n parameter relates to the gas mass through the gas' molecular weight, being, this way, the mass of the gas stored in the chamber able to be known. For gases not complying with or not well conforming with the ideal gas equation, there is the virial equation, which contains correction factors for the parameters to operating conditions.

The method of dosing gases comprises the steps of: allowing the controlled entry of gas from a storage container or compressed gas supply to a metering chamber (9) of a constant volume; measuring the pressure by means of a pressure sensor that continuously records the increase of pressure inside the metering chamber up to a preset value; once the desired pressure has been reached, close the intake valve (3); measuring the temperature of the gas stored in the metering chamber by way of a temperature sensor (6); determining, through the microprocessor, the necessary drop of pressure inside the metering chamber to discharge the volume or mass of gas as pre-set in the control panel; measuring, on a continues basis, the external temperature by means of an external temperature sensor; carrying out the application with the dosing gun, which transmits a signal to the microprocessor; after receiving the application signal, the microprocessor allows to open the outlet valve to start discharging the gas from the metering chamber; during the discharge of the gas, the drop of pressure inside the metering chamber must be permanently measured until it reaches the pre-set value; after the microprocessor has detected the pre-set pressure inside the metering chamber, the outlet valve must be closed. The charging cycle may then be repeated.

The amount of gas to be dosified, at external room temperature, has been specified on the control panel by means of the incorporation of the gas volume or mass parameters.

A regular loading cycle that regard the basic parameters as entered into the control panel comprises the steps of:

opening the intake valve, keeping closed the outlet valve and continuously measuring the pressure inside the metering chamber by means of internal pressure sensor, until the pre-set value is reached to produce the dosing. When this pre-set value is reached based on the parameters entered into the control panel, the intake valve must be closed and the measurement of the temperature is started. The apparatus, if equipped with an external pressure sensor, measures the external pressure to correct the amount of gas that is to be discharged. If there is no external pressure sensor in place, the pressure value previously determined by means of the internal pressure sensor is used, as described above. Along with this, the apparatus measures the external temperature by means of an external temperature sensor. The apparatus performs this measurements until receiving the discharge (or dosing) signal from the operator that activated the injection system. At that moment the last internal pressure, internal temperature, external temperature and external pressure values are recorded. With these values, the microprocessor resolves the formula indicate below to determine the final internal pressure that there must be inside the metering chamber to deliver the necessary amount of gas to dosify the exact quantity of gas in the container. Once the microprocessor has obtained the final internal pressure value to existing conditions, the microprocessor sends the signal for opening the outlet valve while measuring, on a continuous basis, the internal pressure inside the metering chamber until the final pressure as calculated is reached. Then, the outlet valve is closed, with which the dosing operation is completed. Immediately afterwards, the cycle is repeated to again fill the chamber and set the equipment for a new dosing operation.

The amount of gas delivered is determined by assuming that there is a number of initial gas moles and that a number of gas moles are to be removed, that the final conditions are to be determined for the gas pressure inside the chamber, referred to as Pf, which determined the final pressure of the gas within the metering chamber based on the following formula:

$$P_f = P_i - \frac{P_e \cdot V_e \cdot T_i}{V_i \cdot T_e}$$

where the sub-indices i are read as interior and exterior, respectively, referring to the interior of the chamber at constant volume and exterior as the conditions at dosing point, being Pi the initial internal pressure inside the metering chamber, Vi being the volume of the metering chamber, Ti the absolute temperature of the gas inside the metering chamber, and with Pe being the external pressure, Ve the volume of gas to be injected, and Te being the absolute external temperature.

As for the formula, the Vi parameter is provided as a basic reference to the apparatus, and corresponds to the volume of the metering chamber of constant volume. As mentioned, the volume of this chamber will depend on the application that is to be given to the apparatus and depends on the parameters of volume or mass for the gas to be injected, on the discharge pressure and on the pressure of the compressed gas supply. The Pe variable corresponds to the pressure at the gas discharge location, which may be determined by using an external pressure sensor or, alternatively, with the internal sensor of the metering chamber using the procedure described in detail further below, in which case the external pressure will be a reference that may be set during the calibration of the apparatus. Ve corresponds to the volume of the gas that is to be injected to the external conditions, that is, the external temperature and pressure conditions where the gas is to be injected.

The volume of the gas to be injected is a parameter that is previously specified based on the data entered the control panel. This value may be input to the control panel directly by entering the volume of gas, or the volume of gas may be determined indirectly based on the mass of the gas entered the control panel and the subsequent conversion to volume according to the ideal gas formula or the number of moles may be directly entered based on the following equation:

$$P_f = P_i - \frac{n_e \cdot R \cdot T_i}{V_i}$$

where ne corresponds to the mass to be dosified, expressed in moles (n=mass/molecular weight of gas), R is the gas constant, Pi corresponds to the initial pressure inside the metering chamber, that is, prior to the commencement of the dosing, Ti is the initial temperature inside the chamber, that is, prior to the commencement of the dosing, Pf is the desired final pressure, which corresponds to the pressure inside the metering chamber after the opening of the dosing valve, which will indicate that the desired amount, as expressed in volume or mass, has already been delivered. This variable is determined by the formula and parameters entered and measured, and then becomes a reference which the internal pressure value, as read by the internal pressure sensor during the dosing, is compared to.

To measure the external pressure as an option of the gas dosing apparatus without an external sensor, the following procedure must be performed: in the control panel, the mode of external pressure specification must be selected. The processor opens the outlet valve releasing gas accumulated therein, while it continuously measures the pressure inside the metering chamber. The pressure drops and stabilizes when reaching the pressure at the injection zone. The exit of the valve must be located where the injection takes place regularly. The processor verifies, for some seconds, the stability of the measurement, and if this remains without any changes, takes the value measured. This value is stored as a referential value to Pe, using it for subsequent calculations. The processor indicates, through the control panel, that the measurement has been completed, it closes the valve and exits the menu for setting the external pressure. The processor fills the chamber with gas to be ready for the next injection, using previously entered parameters.

The entering of the parameters is performed by using the functions provided on the control panel, or by the transfer of information through a data channel. In the case of the data channel, the information is transferred directly to the processor using a computer or intermediary system allowing this action. When using the panel, each one of the sub-menus corresponding to each one of the parameters that needs to be entered must be opened, reason by which there is a digital display that allows to visualize the value entered or to be entered, and knobs and pushbuttons that allow to select the menus or input the values. This panel also has led indicators for different status, such as on, off, alarm, without pressure, etc. so that they allow the user to promptly know the status of the equipment.

The gas dosing apparatus may have an electric power supply. The power supply may be the regular power supply network or of any other kind such as batteries, generators, solar cells aeolian energy systems, provided that they are able to generate the required power for its operation. The power supply relates to the size of the equipment, although, in general, a 12 to 24 volt power supply is preferred for feeding the systems, and the amperage as determined by its components.

A preferred form of power supply is the use of batteries attached to the equipment, so that they allow its operation during a work's day without a recharge. The recharge may be performed by connecting the equipment to a electric power supply by means of a charger. This form of power makes it possible for the apparatus to be used in remote locations without the need of a permanent connection to a fixed power supply.

The gas dosing apparatus of the present invention is of a size that may vary depending on the application or use thereof; for example, the equipment format may be small, such as a portable unit, or its format may be larger such as that of a stationary unit.

Based on the above, two other preferred embodiments of the dosing apparatus may be presented.

A preferred embodiment of the dosing apparatus of the present invention considers a totally portable equipment comprising a dosing gun having a weight that allows it to be entirely carried by a human being as well as free operation thereof. This dosing apparatus uses a small tank or container as a compressed gas supply, permitting storage of the gas that is to be dosified and allowing some operating time. For example, it allows the storage of gas that may be used during a whole work's day or half work's day; once this period of time has elapsed, the compressed gas supply must be recharged from a larger gas container.

The dosing apparatus of the present invention is of a small size, wherein the metering chamber occupies the main volume, this being the major restriction to the use of these portable units.

The electronic circuits of the present invention are inherent to the small size, as are all its other electromechanical components. The batteries must be sized to this use and, depending on the use of the equipment, it may require the replacement thereof during its normal operation. The equipment has an external battery recharge system, as well as an internal one.

Another embodiment of the dosing apparatus of the present invention may be a combination of the previous embodiments, using the same dosing gun, but the gas may be supplied through an external line, thus avoiding the container. Likewise, the electric power may be supplied externally from the stationary power supply system or other power supply, or with the use of batteries.

The invention claimed is:

1. A gas dosing apparatus comprising a metering chamber of known volume for containing a gas to be injected, a supply of compressed gas connected to the metering chamber by an inlet duct, and a dosing injector connected to the metering chamber by an outlet duct, wherein said metering chamber has at least one sensor for measuring the pressure inside the metering chamber, at least one sensor for measuring the temperature inside the metering chamber, at least one temperature sensor exposed to the environment located on an external part of the gas dosing apparatus for measuring the temperature outside the metering chamber, and at least one pressure sensor exposed to the environment located on an external part of the gas dosing apparatus for measuring the pressure outside the metering chamber.

2. The gas dosing apparatus according to claim 1, wherein between the compressed gas supply and the metering chamber there is located an intake valve.

3. The gas dosing apparatus according to claim 2, wherein the intake valve is an electrovalve that regulates the flow of gas from the compressed gas supply to the metering chamber.

4. The gas dosing apparatus according to claim 2, wherein between the compressed gas supply and the intake valve there is a gas shut-off valve.

5. The gas dosing apparatus according to claim 1, wherein between the metering chamber and the dosing injector there is located an outlet valve.

6. The gas dosing apparatus according to claim 5, wherein the outlet valve is an electrovalve that regulates the flow of gas from the metering chamber to the dosing injector.

7. The gas dosing apparatus according to claim 1, wherein the pressure sensor in the metering chamber continuously measures the pressure inside the metering chamber, or each time a pressure record is required.

8. The gas dosing apparatus according to claim 1, wherein the temperature sensor in the metering chamber continuously measures the temperature of the gas inside the metering chamber at regular intervals or each time a pressure record is required.

9. The gas dosing apparatus according to claim 1, wherein the temperature sensor located on the external part of the gas dosing apparatus, measures room temperature in the location where the dosing injector is located, said temperature sensor measuring the external temperature on a continuous basis, at regular intervals, or each time a temperature record is required.

10. The gas dosing apparatus according to claim 1, wherein the temperature sensor located on the external part of the gas dosing apparatus is an array of temperature sensors.

11. The gas dosing apparatus according to claim 1, wherein the compressed gas supply contains a compressed gas or is a pressurized line from which the gas to be dosified may be obtained.

12. The gas dosing apparatus according to claim 1, wherein the temperature and pressure sensors are connected to an electronic control system.

13. The gas dosing apparatus according to claim 12, wherein the electronic control system includes a digital microprocessor circuit and a control panel.

14. The gas dosing apparatus according to claim 13, wherein the microprocessor processes information provided by the temperature and pressure sensors, and performs calculations from data entered by the control panel to determine the correct amount of gas to be injected.

15. A method of gas dosing comprising the steps of: allowing a predetermined amount of gas to flow to a metering chamber of known volume; measuring the pressure and temperature of the gas inside the metering chamber with internal pressure and temperature sensors; measuring the temperature outside the metering chamber with an external temperature sensor; measuring the pressure outside the metering chamber with an external pressure sensor; and allowing the discharge of a pre-set amount of gas from the metering chamber based on the measurements of the temperature and pressure sensors.

16. The method of gas dosing according to claim 15, wherein an intake valve controls entry of gas from a compressed gas supply to the metering chamber while an outlet valve allowing discharge of gas from the metering chamber is closed.

17. The method of gas dosing according to claim 16, wherein the measurement of pressure by the internal pressure sensor records the increase in the pressure inside the metering chamber up to a pre-set value.

18. The method of gas dosing according to claim 17, wherein once the pre-set value of the pressure has been reached the intake value is closed.

19. The method of gas dosing according to claim 18, wherein once the intake valve has been closed, the temperature of the gas stored in the metering chamber is measured by the internal temperature sensor.

20. The method of gas dosing according to claim 17, wherein the gas is discharged from the metering chamber with a dosing gun, which gun transmits a signal to a microprocessor, the microprocessor, once it has received the signal, opening the outlet valve to start the discharge of the gas from the metering chamber.

21. The method of gas dosing according to claim 20, wherein once the microprocessor has detected the pre-set pressure within the metering chamber, it closes the gas outlet valve.

22. The method of gas dosing according to claim 15, wherein the cycle is repeated to refill the metering chamber for a new dosing operation.

* * * * *